US006662863B2

(12) United States Patent
Igami et al.

(10) Patent No.: US 6,662,863 B2
(45) Date of Patent: Dec. 16, 2003

(54) STRUCTURE OF HEAT EXCHANGER TANK

(75) Inventors: Takaji Igami, Nagoya (JP); Kiyoaki Horie, Nagoya (JP)

(73) Assignee: Toyo Radiator Co., Ltd., Tokyo (JP)

( * ) Notice: Subject to any disclaimer, the term of this patent is extended or adjusted under 35 U.S.C. 154(b) by 0 days.

(21) Appl. No.: 10/188,386

(22) Filed: Jul. 2, 2002

(65) Prior Publication Data

US 2003/0019615 A1 Jan. 30, 2003

(30) Foreign Application Priority Data

Jul. 6, 2001 (JP) ..... 2001-206876

(51) Int. Cl.[7] ..... F28F 9/02
(52) U.S. Cl. ..... 165/174; 165/175; 165/906
(58) Field of Search ..... 165/173–175, 165/906; 29/890.052

(56) References Cited

U.S. PATENT DOCUMENTS 4,936,381 A * 6/1990 Alley ..... 165/176
5,123,483 A * 6/1992 Tokutake et al. ..... 165/176
5,351,751 A * 10/1994 Cage et al. ..... 165/173
6,289,980 B1 * 9/2001 Insalaco et al. ..... 165/174
6,311,768 B1 * 11/2001 Jamison et al. ..... 165/173
6,332,495 B1 * 12/2001 Jamison et al. ..... 165/153

FOREIGN PATENT DOCUMENTS

FR 2614980 A * 11/1988 ..... 165/906

* cited by examiner

*Primary Examiner*—Leonard R Leo
(74) *Attorney, Agent, or Firm*—Jordan and Hamburg LLP

(57) ABSTRACT

A tank body 3 is formed in the shape of an elongated groove having an intermediate first slit 5 disposed at its middle portion in the longitudinal direction and having a pair of end first slits 5*a* disposed at its opposite ends. A reinforcement member 9 is fitted in the first slit 5 at the middle portion, and a pair of reinforcement side lids 11 are fitted correspondingly in the pair of end first slits 5*a* at opposite ends. The reinforcement member 9 and the reinforcement side lids 11 are formed with intermediate second slits 8 and end second slits 8*a*, respectively, which in cooperation serve to clamp the sidewalls 2 of the tank body 3. The opening of the tank body 3 is fitted to the groove-shaped tube plate 4 such that their connections are joined together by brazing or other joining means.

4 Claims, 2 Drawing Sheets

STRUCTURE OF HEAT EXCHANGER TANK

BACKGROUND OF THE INVENTION

1. Field of the Invention

The present invention relates to a connection structure of a metallic tank for use in a heat exchanger of automobiles, etc.

2. Description of the Related Arts

The conventional heat exchanger metallic tank is provided with an elongated box-shaped tank body having an open end, and a tube plate adapted to block the open side. The tank body is manufactured through a plurality of deep drawing steps by means of press machines.

In case of manufacturing the tank body through the plurality of press drawing steps, a plurality of dedicated molds are needed increasing the cost for the manufacture of the molds, which results in a higher price of the heat exchanger as a whole.

When the tube plate is fitted and brazed to the tank body opening, the fitting portions at corners, esp., of the tank body and the tube plate may not necessarily be in registration with each other. This is attributable to a possible spring back or the like in the press forming. As a result, a leak may occur from the fitting portion at the corners after brazing.

SUMMARY OF THE INVENTION

It is therefore the object of the present invention to overcome the above deficiencies.

In order to attain the above object, according to a first aspect of the present invention there is provided a heat exchanger tank structure comprising:

a tank body formed from a bent metal plate in the shape of an elongated groove, the tank body having a bottom and two parallel sidewalls;

a tube plate having an open side which confronts the bottom of the tank body, the open side adapted to securely be fitted to the tank body;

the bottom of the tank body having one or more first slits formed over the full width of the bottom in a parallel relationship in the width direction; and a metallic reinforcement member having an outer periphery which conforms to the contour of the tank body, the reinforcement member having at its top a slit fitting portion which mates with the first slit, the reinforcement member having at its both sides a pair of second slits into which the two sidewalls are inserted;

wherein the top of the reinforcement member is fitted in the first slit of the tank body, with the pair of second slits of the reinforcement member clamping both sides of the tank body, to thereby provide a liquid-tight connection therebetween.

According to a second aspect of the present invention there is provided a heat exchanger tank structure comprising:

a tank body formed from a bent metal plate in the shape of an elongated groove, the tank body having a bottom and two parallel sidewalls;

a tube plate having an open side which confronts the bottom of the tank body, the open side adapted to securely be fitted to the tank body;

the bottom of the tank body having, at its intermediate portion in the longitudinal direction, one or more intermediate first slits formed over the full width of the bottom in a parallel relationship in the width direction; and a metallic reinforcement member in the shape of a gate in plan having at its top a slit fitting portion adapted to mate with the intermediate first slit, the reinforcement member including two legs having a pair of intermediate second slits into which the two sidewalls of the tank body are inserted;

wherein the top of the reinforcement member is fitted in the intermediate first slit of the tank body, with the pair of intermediate second slits of the reinforcement member clamping both sides of the tank body, to thereby provide a liquid-tight connection therebetween.

According to a third aspect of the present invention there is provided a heat exchanger tank structure comprising:

a tank body formed from a bent metal plate in the shape of an elongated groove, the tank body having a bottom and two parallel sidewalls;

a tube plate in the shape of a shallow groove having an open side which confronts the bottom of the tank body, the open side adapted to securely be fitted to the tank body;

the bottom of the tank body having a pair of end first slits formed over the full width of the bottom in a parallel relationship in the width direction; and a pair of reinforcement side lids having an outer periphery which conforms to the grooved-shaped section of the tank body, the pair of reinforcement side lids each having at its bottom edge a slit fitting portion which mates with corresponding one of the pair of end first slits, the pair of reinforcement side lids each having a pair of end second slits which receive the sidewalls of the tank body, the pair of reinforcement side lids each having a protrusion formed on an edge confronting the tube plate;

the tube plate having a pair of locking holes formed in the tube plate at its opposite ends, the locking hole adapted to mate with the protrusion;

wherein the top of each of the pair of reinforcement side lids is fitted in corresponding one of the pair of end first slits such that the pair of end second slits clamp the two sidewalls of the tank body and that the protrusions are fitted in the locking holes of the tube plate, to thereby provide a liquid-tight connection therebetween.

The first slit may extend through the full width of the bottom of the tank body and, contiguous therewith, through a part of the two sidewalls in the region of the bottom, and the second slit may be inserted through the edges of the first slit associated with the sidewalls into the tube plate.

BRIEF DESCRIPTION OF THE DRAWINGS

The above and other objects, aspects, features and advantages of the present invention will become more apparent from the following detailed description when taken in conjunction with the accompanying drawings, in which.

DESCRIPTION OF THE PREFERRED EMBODIMENTS

The present invention will now be described with reference to the accompanying drawings which illustrate preferred embodiments thereof in a non-limitative manner.

Figure 1:
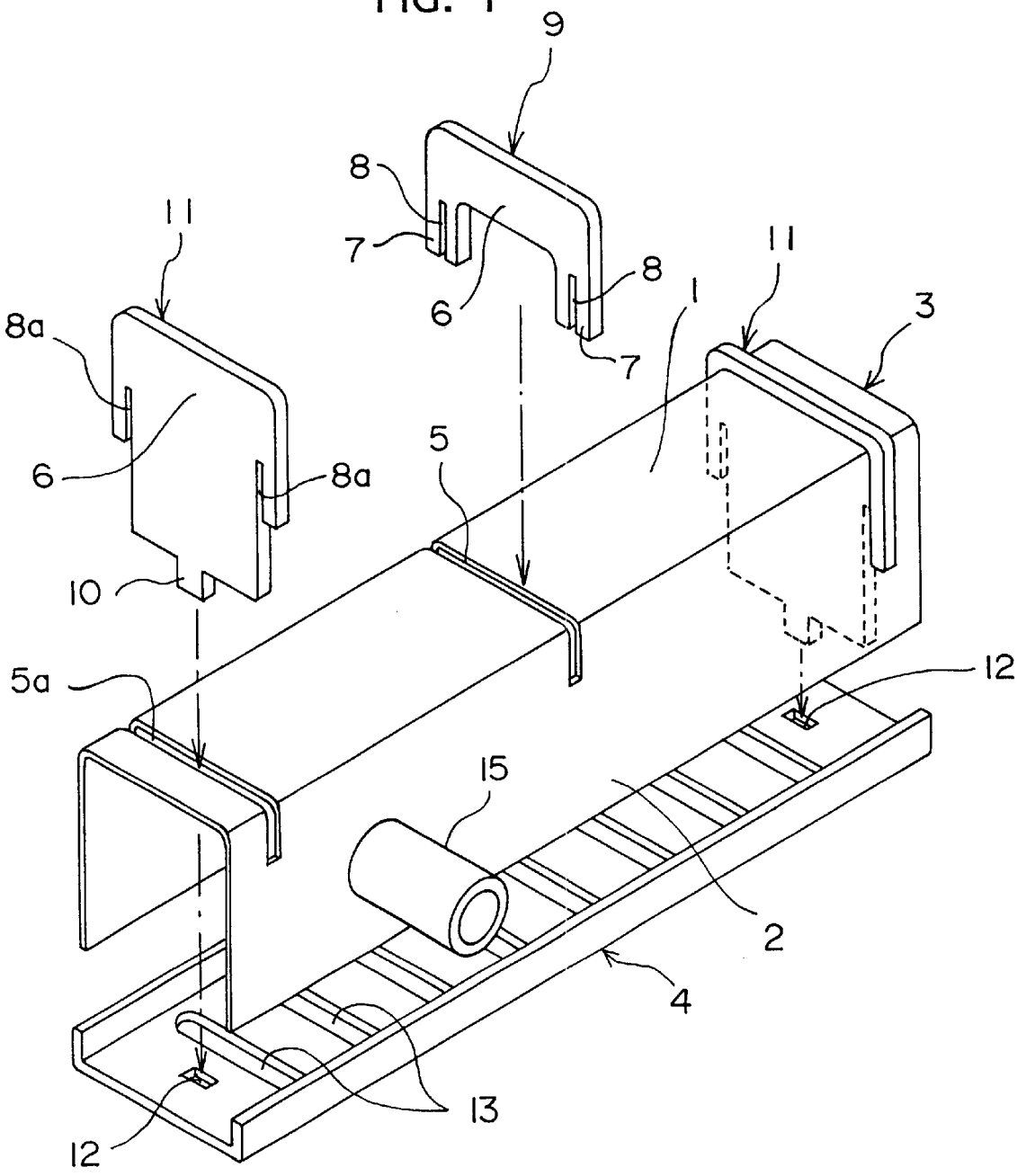
FIG. 1 is an exploded perspective view of a heat exchanger tank structure in accordance with the present invention.
Figure 2:
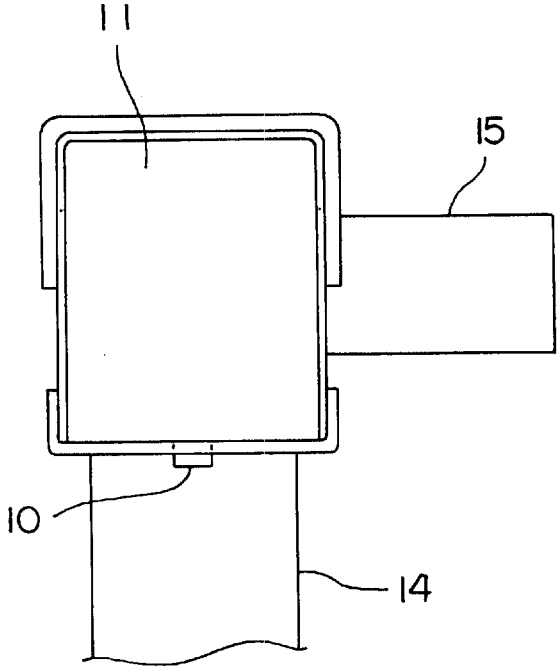
FIG. 2 is a side view of the principal part, showing the assembled state of the tank structure.

FIG. 1 is an exploded perspective view of a tank structure in accordance with the present invention, and FIG. 2 is a side view of the principal part, showing the assembled state.

This heat exchanger tank structure comprises a tank body generally designated at 3 and formed from a bent aluminum or other metal plate, having a bottom 1 and a pair of sidewalls 2 opposing in its width direction. The tank structure further comprises a tube plate generally designated at 4, in the shape of a shallow groove, securely fitted to the opening which confronts the bottom 1 of the tank body 3. The tube plate 4 includes a multiplicity of tube insertion apertures 13 juxtaposed in its longitudinal direction, and a pair of locking holes 12 disposed at opposite ends thereof.

The tank body 3 has at the middle in its longitudinal direction one or more intermediate first slits 5 which are formed in parallel in the width direction through the full width of the bottom 1 and are extended through a part of the sidewalls. The tank body 3 has at opposite ends in its longitudinal direction a pair of end first slits 5*a* which also extend through the full width of the bottom 1 and through a part of the sidewalls 2.

A reinforcement member 9 is fitted to the intermediate first slit 5. The reinforcement member 9 has a thickness equal to the width of the intermediate first slit 5. The reinforcement member 9 is in the shape of a gate including two legs 7 having respective intermediate second slits 8 which are fitted on the sidewalls 2 at slit edges associated with the intermediate first slit 5 so as to clamp the corresponding sidewalls.

A reinforcement side lid 11 is fitted in the end first slit 5*a* positioned at the opposite ends of the tank body 3. The reinforcement side lid 11 has a thickness equal to the width of the end first slit 5*a*. The reinforcement side lid 11 has a pair of end second slits 8*a* formed along opposite edges in the width direction, the pair of end second slits 8*a* being fitted on the sidewalls 2 at slit edges associated with the end first slits 5*a* so as to clamp the corresponding pair of sidewalls 2. The reinforcement side lid 11 has at its bottom a protrusion 10 which is in registration with the locking hole 12 of the tube plate 4.

One of the pair of the sidewall 2 is provided with a pipe connection opening which receives one end of the pipe 15. The multiplicity of tube insertion apertures 13 of the tube plate 4 receive ends of corresponding number of flat tubes 14. Corrugated fins not shown are disposed in regions between adjacent tubes 14. Such components can be ones at least one of which in contact with each other has a surface coated with a brazing material.

<Assembling Method>

The reinforcement member 9 is fitted and positioned in the intermediate first slit 5 of the tank body 3 such that its intermediate second slit 8 can clamp both sides of each of the pair of sidewalls 2. The reinforcement side lid 11 is fitted and positioned in the end first slit 5*a* disposed in the tank body 3 at its opposite ends in the longitudinal direction such that its end second slit 8*a* can clamp the inner and outer surfaces of each of the pair of sidewalls 2. The thus assembled tank body 3 is then mounted on the tube plate 4 such that the protrusions 10 of the reinforcement side lids 11 fit in the corresponding locking holes 12. The multiplicity of tubes 14 are previously inserted from their ends through the corresponding tube insertion apertures 13, with the fins arranged between the adjacent tubes.

The thus assembled heat exchanger is inserted as a whole into a furnace at a high temperature so that the coated brazing material is fused and then cooled and solidified to finally provide integral brazing between components.

Figure 3:
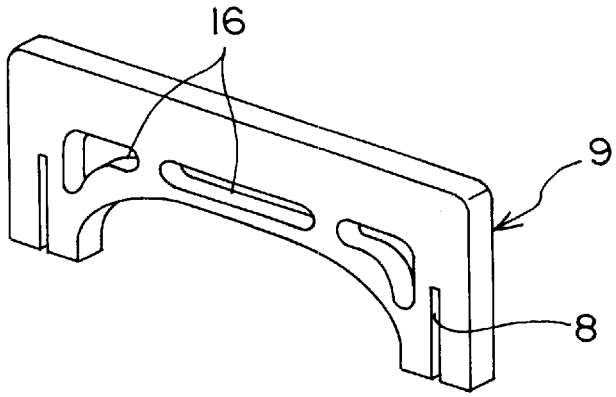
FIG. 3 is a perspective view of another embodiment of a reinforcement member for use in the tank structure.

Reference is then made to FIG. 3 which illustrates another embodiment of the reinforcement member 9 for use in the present invention. In this example, the flat surface of the reinforcement member 9 includes a plurality of air vents 16 arranged at proper locations. When the reinforcement member 9 is fitted in the intermediate first slit 5 of the tank body 3, the plurality of air vents 16 are positioned on the inside of the tank body 3. The plurality of air vents 16 serve to allow air to freely flow through the interior of the tank body 3 by way of the air vents 16 when there occurs air accumulation within the interior of the tank body 3.

This is in particular needed for the upper tank when the heat exchanger is used as an engine coolant cooling radiator.

The heat exchanger tank structure of the present invention allows the tank body 3 and the reinforcement member to be connected together in a liquid-tight fashion, with the reinforcement members being fitted in the first slits at the bottom 1 of the tank body 3, the second slits of the reinforcement member clamping both sides of the tank body 3, thus making it possible to reinforce the sidewalls and definitely position the distance between the pair of sidewalls. This leads to an increased pressure resistance, capability to strictly specify the relative dimensions of the bottom 1 and the tube plate 4, and improved reliability of the connection between the two.

According to the invention defined in claim 2, the reinforcement for the tank body can be effected at the intermediate portion of the tank body.

According to the invention defined in claim 3, the reinforcement side lids 11 are fitted in the pair of end first slits 5*a* in the bottom 1 at the opposite ends of the tank body 3 in the longitudinal direction, with the end second slits 8*a* of each reinforcement side lid 11 clamping the sidewalls 2 of the tank body 3 for connection, whereby it is possible to definitely specify the opposed distance between the pair of sidewalls at the opposite ends of the tank body 3 in the longitudinal direction and to achieve the conformability with the tube plate 4 to thereby improve the brazing reliability.

By virtue of fitting of the protrusions 10 of the reinforcement side lids 11 into the locking holes 12 of the tube plate 4 for locking , the tank body 3 is prevented from rising from the tube plate 4 upon connection. The tank body 3 itself can be manufactured only by bending and slit forming the metal plate without needing the deep drawing, thus resulting in a simplified mold for the sidewalls 2 and consequently in a reduction of the manufacturing costs. Similarly, the tube plate 4 itself can be of a shallow groove type, which contributes to a simplification of the molds and to a further reduction of the manufacturing costs.

While illustrative and presently preferred embodiments of the present invention have been described in detail herein, it is to be understood that the inventive concepts may be otherwise variously embodied and employed and that the appended claims are intended to be construed to include such variations except insofar as limited by the prior art.

What is claimed is:

1. A heat exchanger tank structure comprising:

a tank body formed from a bent metal plate in the shape of an elongated groove, said tank body having a bottom and two parallel sidewalls;

a tube plate having an open side which confronts said bottom of said tank body, said open side adapted to securely be fitted to said tank body;

said bottom of said tank body having one or more first slits formed over the full width of said bottom in a parallel relationship in the width direction; and a metallic reinforcement member having an outer periphery which conforms to the contour of said tank body, said reinforcement member having at its top a slit fitting portion which mates with said first slit, said reinforcement member having at its both sides a pair of second slits into which said two sidewalls are inserted;

wherein the top of said reinforcement member is fitted in said first slit of said tank body, with said pair of second slits of said reinforcement member clamping both sides of said tank body, to thereby provide a liquid-tight connection therebetween.

2. A heat exchanger tank structure comprising:

a tank body formed from a bent metal plate in the shape of an elongated groove, said tank body having a bottom and two parallel sidewalls;

a tube plate having an open side which confronts said bottom of said tank body, said open side adapted to securely be fitted to said tank body;

said bottom of said tank body having, at its intermediate portion in the longitudinal direction, one or more intermediate first slits formed over the full width of said bottom in a parallel relationship in the width direction; and a metallic reinforcement member in the shape of a gate in plan having at its top a slit fitting portion adapted to mate with said intermediate first slit, said reinforcement member including two legs having a pair of intermediate second slits into which said two sidewalls of said tank body are inserted;

wherein the top of said reinforcement member is fitted in said intermediate first slit of said tank body, with said pair of intermediate second slits of said reinforcement member clamping both sides of said tank body, to thereby provide a liquid-tight connection therebetween.

3. A heat exchanger tank structure comprising:

a tank body formed from a bent metal plate in the shape of an elongated groove, said tank body having a bottom and two parallel sidewalls;

a tube plate in the shape of a shallow groove having an open side which confronts said bottom of said tank body, said open side adapted to securely be fitted to said tank body;

said bottom of said tank body having a pair of end first slits formed over the full width of said bottom in a parallel relationship in the width direction; and a pair of reinforcement side lids having an outer periphery which conforms to the grooved-shaped section of said tank body, said pair of reinforcement side lids each having at its bottom edge a slit fitting portion which mates with corresponding one of said pair of end first slits, said pair of reinforcement side lids each having a pair of end second slits which receive said sidewalls of said tank body, said pair of reinforcement side lids each having a protrusion formed on an edge confronting said tube plate;

said tube plate having a pair of locking holes formed in said tube plate at its opposite ends, said locking hole adapted to mate with said protrusion;

wherein the top of each of said pair of reinforcement side lids is fitted in corresponding one of said pair of end first slits such that said pair of end second slits clamp said two sidewalls of said tank body and that said protrusions are fitted in said locking holes of said tube plate, to thereby provide a liquid-tight connection therebetween.

4. The heat exchanger tank structure according to any one of claims 1 to 3, wherein said first slit extends through the full width of said bottom of said tank body and, contiguous therewith, through a part of said two sidewalls in the region of said bottom, and wherein said second slit is inserted through the edges of said first slit associated with said sidewalls into said tube plate.

* * * * *